US007696872B2

(12) United States Patent
Burwell et al.

(10) Patent No.: US 7,696,872 B2
(45) Date of Patent: Apr. 13, 2010

(54) RACK MOUNTED ACCESS/SECURITY CONTROL PANEL

(75) Inventors: Robert A. Burwell, Kensington, NH (US); Andrew J. Pavlik, Raymond, NH (US)

(73) Assignee: Surveillance Specialties, Ltd., Wilmington, MA (US)

( * ) Notice: Subject to any disclaimer, the term of this patent is extended or adjusted under 35 U.S.C. 154(b) by 240 days.

(21) Appl. No.: 11/857,743

(22) Filed: Sep. 19, 2007

(65) Prior Publication Data

US 2008/0068161 A1 Mar. 20, 2008

Related U.S. Application Data

(63) Continuation-in-part of application No. 11/613,545, filed on Dec. 20, 2006.

(60) Provisional application No. 60/845,794, filed on Sep. 19, 2006.

(51) Int. Cl.
*G08B 13/00* (2006.01)

(52) U.S. Cl. ..... 340/541; 340/539.31; 340/679; 340/568.4

(58) Field of Classification Search ..... 340/541, 340/539.31, 545.1, 547, 548, 568.3, 568.4, 340/565, 656, 679, 676
See application file for complete search history.

(56) References Cited

U.S. PATENT DOCUMENTS

| | | | | |
|---|---|---|---|---|
| 5,806,673 | A * | 9/1998 | Sanderson | 206/314 |
| 5,854,904 | A * | 12/1998 | Brown | 710/100 |
| 6,118,662 | A | 9/2000 | Hutchison et al. | |
| 6,132,242 | A * | 10/2000 | Hall et al. | 439/532 |
| 6,347,963 | B1 | 2/2002 | Falkenberg et al. | |
| 6,452,809 | B1 * | 9/2002 | Jackson et al. | 361/796 |
| 6,697,258 | B1 * | 2/2004 | Muhlfeld et al. | 361/729 |
| 6,788,504 | B2 | 9/2004 | Vanderkolk | |
| 6,856,508 | B2 * | 2/2005 | Rabinovitz | 361/679.31 |
| 6,958,906 | B2 * | 10/2005 | Wu et al. | 361/679.5 |
| 7,230,791 | B1 * | 6/2007 | Ostwald et al. | 360/92.1 |
| 2003/0051057 | A1 | 3/2003 | Garnett et al. | |
| 2004/0057202 | A1 | 3/2004 | Rabinovitz | |
| 2004/0233983 | A1 | 11/2004 | Crawford et al. | |
| 2007/0147013 | A1 | 6/2007 | Robbins et al. | |
| 2008/0068161 | A1 | 3/2008 | Burwell et al. | |
| 2008/0068783 | A1 | 3/2008 | Burwell et al. | |
| 2008/0205018 | A1 | 8/2008 | Burwell et al. | |

FOREIGN PATENT DOCUMENTS

WO WO-2008036326 A2 3/2008

OTHER PUBLICATIONS

Office Action issued Sep. 21, 2009, in parent U.S. Appl. No. 11/613,545, 18 pages.

* cited by examiner

*Primary Examiner*—Daniel Previl
(74) *Attorney, Agent, or Firm*—Nutter McClennen & Fish LLP; David J. Powsner

(57) ABSTRACT

In one aspect, the invention provides an access panel that comprises one or more access control boards, each of which provide at least an interface for controlling access to one or more building entry points or zones (via associated sensors) and for monitoring intrusion prevention devices. The access panel includes at least one connector that provides communications coupling between at least one of the control boards and the aforementioned sensors or intrusion prevention devices (e.g., detectors, electrified locks, etc.). That connector permits that coupling without requiring that a field technician, or other person installing the panel at a site, pass wire through the enclosure in order to establish that communications coupling.

14 Claims, 11 Drawing Sheets

RACK MOUNTED ACCESS/SECURITY CONTROL PANEL

This is a continuation-in-part of U.S. patent application Ser. No. 11/613,545, filed Dec. 20, 2006, which claims the benefit of priority of U.S. Provisional Patent Application Ser. No. 60/845,794, filed Sep. 19, 2006, the teachings of both of which are incorporated herein by reference.

BACKGROUND OF THE INVENTION

The invention pertains to access/security control systems. It has application in the protection of buildings, homes, properties and people.

Access control typically refers to electromechanical security products/systems that monitor and control access in and out of buildings or other properties. Often, an access control system utilizes third party software to communicate with electronic panels that authorize a door to open, lock, be held, or any other combination of events through the use of electronic control hardware that is physically attached to the door.

The panels (referenced above) that are utilized for this process are typically wall-mounted in a centralized area (communications closet, security office, telephone room, etc.). Regardless of where the panels are physically located, the panels are connected to a computer server that controls access to each door by authorizing individuals with proper credentials to enter the space.

Literally, there are hundreds of companies that manufacture access control software and each of them manufactures their own access control panel that is intended to be wall-mounted. These manufacturer's also sell separately the circuit boards that are in a typical panel/enclosure as a "board only" component (i.e. sold without the wall mounted panel).

A typical security integrator buys "board only" components and mounts them in enclosures (e.g., provided by the components manufacturer) for wall-mounting. This often takes many hours and after mounting it takes many more hours in the field to make all of the connections.

An object of the invention is to provide improved access control panels and methods.

A further object is to provide such panels and methods as speed and lower the cost of installation.

A still further object is to provide such panels and methods as can be used with control boards from multiple manufacturers.

A still further object is to provide such panels and methods as can be used in an IT environment (e.g., a computer room).

SUMMARY OF THE INVENTION

The foregoing objects are provided by the invention which provides apparatus and methods for access (or security) control.

In one aspect, the invention provides an access panel that comprises one or more access control boards, each of which provide at least an interface for controlling access to one or more building entry points or zones (via associated sensors) and for monitoring intrusion prevention devices. The access panel includes at least one connector that provides communications coupling between at least one of the control boards and the aforementioned sensors or intrusion prevention devices (e.g., detectors, electrified locks, etc.). That connector permits such coupling without requiring that a field technician, or other person installing the panel at a site, pass wire through the enclosure in order to establish that communications coupling.

Further aspects of the invention provide such an access panel in which multiple such connectors are provided, e.g., on a printed circuit board that comprises or is integral to, a rear panel (or other wall) of the enclosure. In such aspects, each connector can permit coupling as described above to one or more common control boards and/or more respective sensor or intrusion prevention devices.

Still further aspects of the invention provide such an access panel as supports control boards comprising multiple different "platforms," i.e., of different third-party (or other) manufacturers. In these aspects, the access panel comprises a backplane on which the control boards are mounted (or otherwise disposed) and that comprise one or more arrangements of apertures, mounting pins, and the like supporting such mounting (or disposal). The access panel further comprises power and electrical interfaces that support both the control boards and the sensors and/or intrusion prevention devices.

Further related aspects of the invention provide such an access panel in which the power unit is of toroidal configuration.

Further related aspects of the invention provide such an access panel that includes a wiring harness that carries communications signals from the one or more connectors to the control boards.

Further related aspects of the invention provide such an access panel that is configured for rack mounting.

In one aspect, the invention provides a powered access panel comprising an IT rack-mountable enclosure designed to house all the necessary control components that make up a fully functioning access control panel. The enclosure is two or four rack units high and is designed to mount in a standard EIA twenty six inch deep electronics rack. The panel incorporates power supplies, power distribution boards, system control boards and a signal transfer board into one rack mounted enclosure. The unit utilizes interchangeable backplanes to accommodate a variety of third party access control boards (these backplanes serve as a universal connector, that allow us to mount control boards from various manufacturers).

Further aspects provide methods for assembly, installation and use of control access panels as described above.

These and other aspects of the invention are evident in the drawings and text that follows.

BRIEF DESCRIPTION OF THE ILLUSTRATED EMBODIMENT

DETAILED DESCRIPTION OF THE ILLUSTRATED EMBODIMENT

Figure 1:
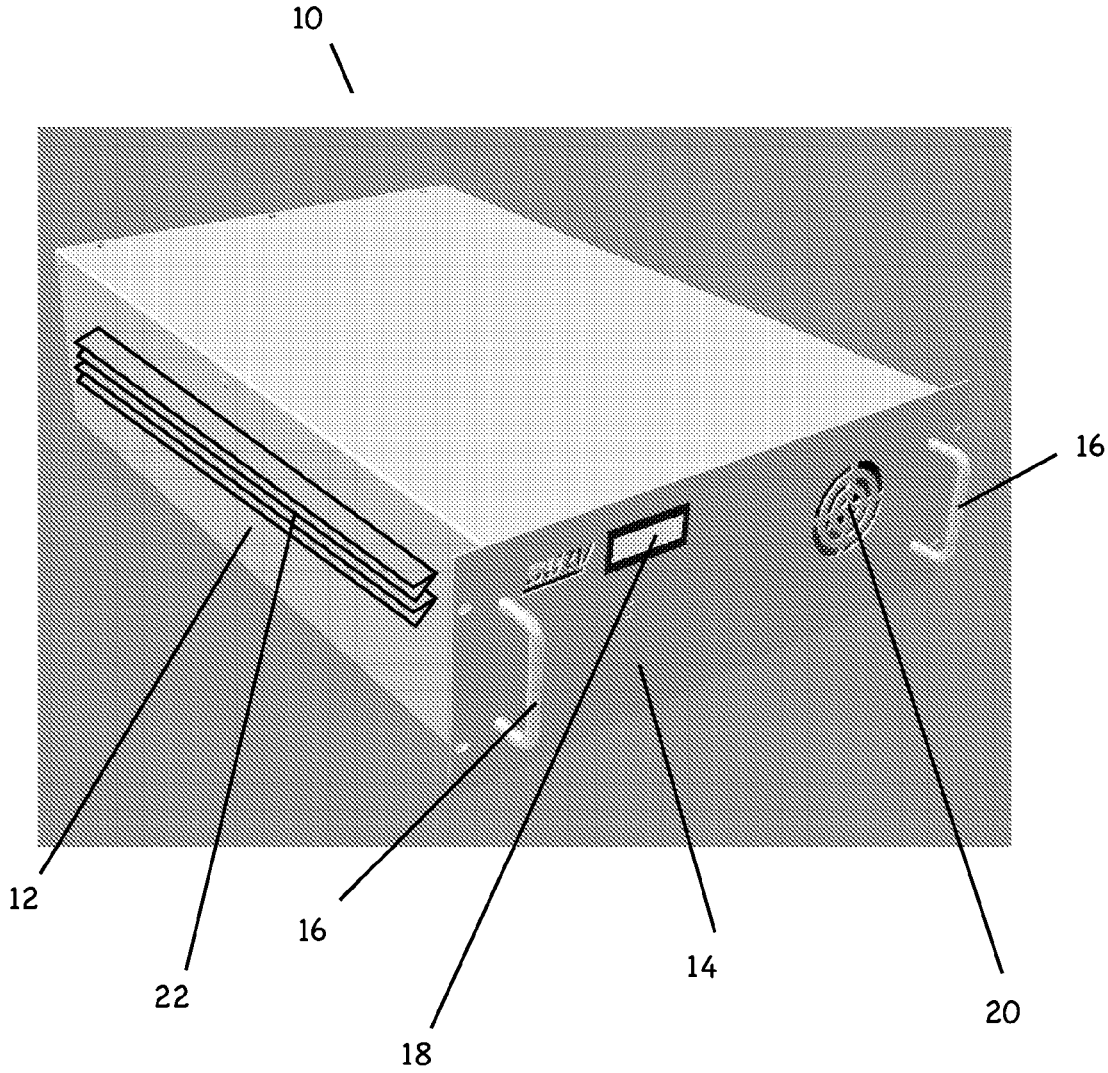
FIG. 1 depicts a rack-mounted access control panel according to one practice of the invention.

FIG. 1 depicts a rack-mounted access control panel 10 according to one practice of the invention. The panel 10 includes an enclosure 12 having a front panel 14, as shown. The enclosure 12 provides a rigid framework onto which mechanical, electromechanical, integrated circuit and other components (collectively, "components") of the panel 10 are mounted and a housing structure that protects those components from dust, moisture, tampering, and so forth. In the illustrated embodiment, enclosure 12 comprises a metal rack-mount chassis of the type conventionally used in the digital data processor server art, the laboratory equipment art, and so forth. Illustrated enclosure 12 is composed of metal and has a height of 4 U, though, in other embodiments it may have a different height (e.g., 2 U), and be composed of plastic, ceramic, composite, or otherwise.

The illustrated front panel 14 is affixed to a front of enclosure 12, as shown. The panel 14, which contributes to mounting and protection of the components of the rack-mount access control panel 10, also facilitates handling and rack-mounting of the panel 10, as well as operator interpretation of panel 10 status. To these ends, illustrated panel 10 incorporates handles 16, a display 18, air flow apertures 20, and slides 22, configured as shown. The handles 16 and slides 22 facilitate sliding of the panel 10 in and out of a rack (not shown), e.g., a standard EIA twenty six inch deep electronics rack, or otherwise. Display 18 displays the status of access control panel 10 and, in the illustrated embodiment, comprises a conventional LCD display of the type known in the art, though in other embodiments it may be of a different type (e.g., LED display). Air flow apertures 20 ensure a stable operating temperature within the enclosure 12 and, in the illustrated embodiment, comprise conventional openings in the front panel 14. One or more fans could, for example, circulate air through such openings, thereby cooling the components inside enclosure 12.

Figure 2:
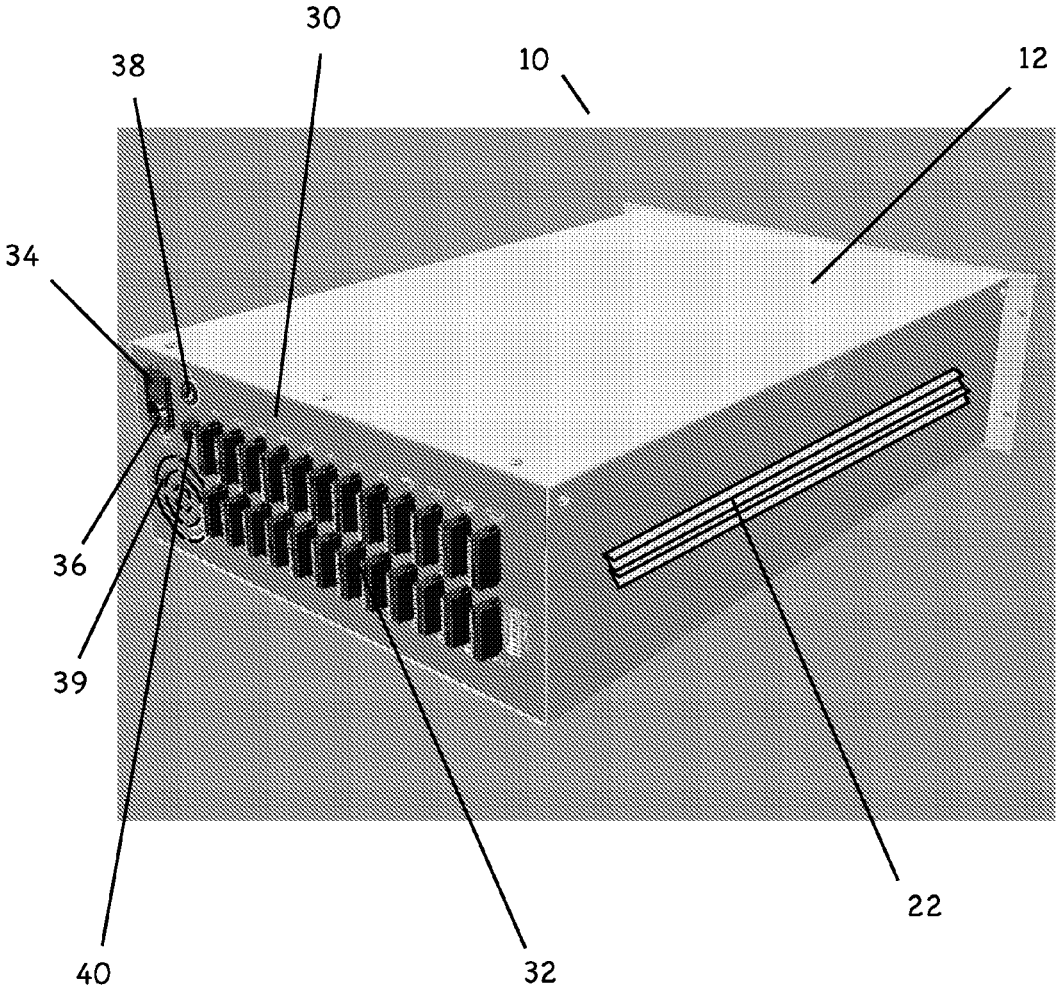
FIG. 2 depicts a rear of the enclosure of FIG. 1 and, specifically, depicts a rear panel having multiple connectors.

FIG. 2 depicts a rear-view of the rack-mounted access control panel 10 of FIG. 1. The access control panel 10 includes a rear panel 30 affixed to a rear of the enclosure 12, as shown. The illustrated rear panel 30 has multiple connectors 32 (as described below), a power switch 34, a power-in port 36, a circuit breaker 38, air flow apertures 39, and a LAN (local area network) port 40, configured as shown. The power switch 34 allows a user to control the flow (e.g., "on" or "off") of electrical power to the access control panel 10 and, in the illustrated embodiment, comprises a conventional toggle switch or otherwise. Illustrated power switch 34 is operated manually, though, in other embodiments it may be operated electronically, remotely, or otherwise.

The power-in port 36 serves as an interface between the access control panel 10 and an external power source. In the illustrated embodiment, power-in port 36 comprises an electrically wired outlet, into which a conventional power plug or cable connects.

The circuit breaker 38 protects the components mounted inside (or outside) enclosure 12 from damage caused by overload or short circuit and, in the illustrated embodiment, comprises a conventional circuit breaker of the type conventionally used in the art. Illustrated circuit breaker 38 is disposed on the rear panel 30, though, in other embodiments it may be disposed on the front panel or other portion of enclosure 12. Still other embodiments may obviate the need for such a circuit breaker 38, e.g., by building such functionality into individual components.

The air flow apertures 39 operate in the same manner as the apertures 20 described above. Illustrated air flow apertures 39 are disposed on the left side of the rear panel 30, though, in other embodiments they may be disposed elsewhere.

The LAN port 40 serves as an interface between the access control panel 10 and an IP network (not shown), e.g., a switched IEEE 802.3 Ethernet network, or otherwise, via which panel 10 may be monitored or controlled and/or to which one or more of the sensors, intrusion prevention devices and other apparatus monitored/controlled by the panel 10 may be coupled. In the illustrated embodiment, LAN port 40 comprises a standard Ethernet port into which an RJ-45 plug or cable connects, though, in other embodiments this may be supplemented and/or replaced with an interface to any variety of wired or wireless networks (e.g., 802.11x, or otherwise).

Figure 3:
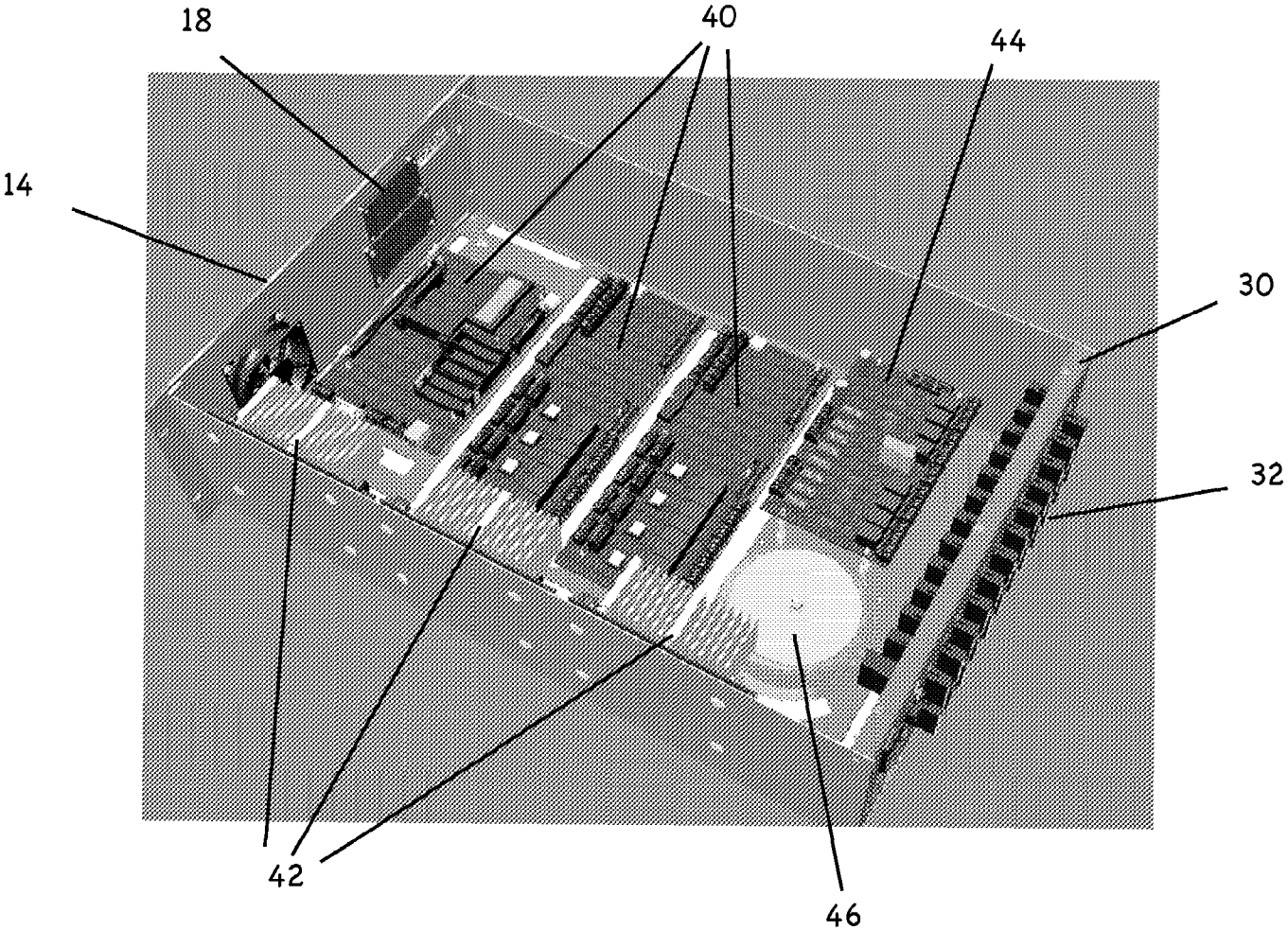
FIG. 3 depicts the internals of the access control panel of FIG. 1.

FIG. 3 depicts the internals of the access control panel 10 of FIG. 1. The panel 10 has components mounted on a base of enclosure 12 and rear panel 30, as shown. The illustrated components include access control boards 40, power supplies 42, power distribution board 44, an array of connectors 32 (discussed below in FIG. 4), and a transformer 46, configured as shown. The access control boards 40 provide an interface for controlling access to one or more building entry points or zones (via associated sensors and/or intrusion prevention devices) and for monitoring intrusion prevention devices. By way of non-limiting example, the control boards 40 may respond to alerts from sensors and/or intrusion prevention devices. In the illustrated embodiment there are three access control boards 40 disposed within enclosure 12, each of the type conventionally used in the art of access control. Other embodiments may include a greater or lesser number of such boards 40, and/or combine the functionality of the control boards 40 with others of the illustrated components.

With further reference to FIG. 3, the illustrated access panel 10 includes three power supplies 42, a power distribution board 44, and a transformer 46, that, together, supply power to the control boards 40 in the conventional manner known in the art. Illustrated transformer 46 is torroidal in shape, though other configurations can be used, and it powers the panel 10 itself and attached peripheral devices (for example, magnetic locks, sensors, etc.), e.g., via DC power supplies 42 or otherwise. Likewise, power distribution board 44 is implemented in printed circuit boards, though other form factors can be used. Moreover, although power supplies 42, power distribution board 44, and transformer 46, are shown separately, in some embodiments, their functionality may be combined and/or distributed among other components of the access panel 10.

Figure 4:
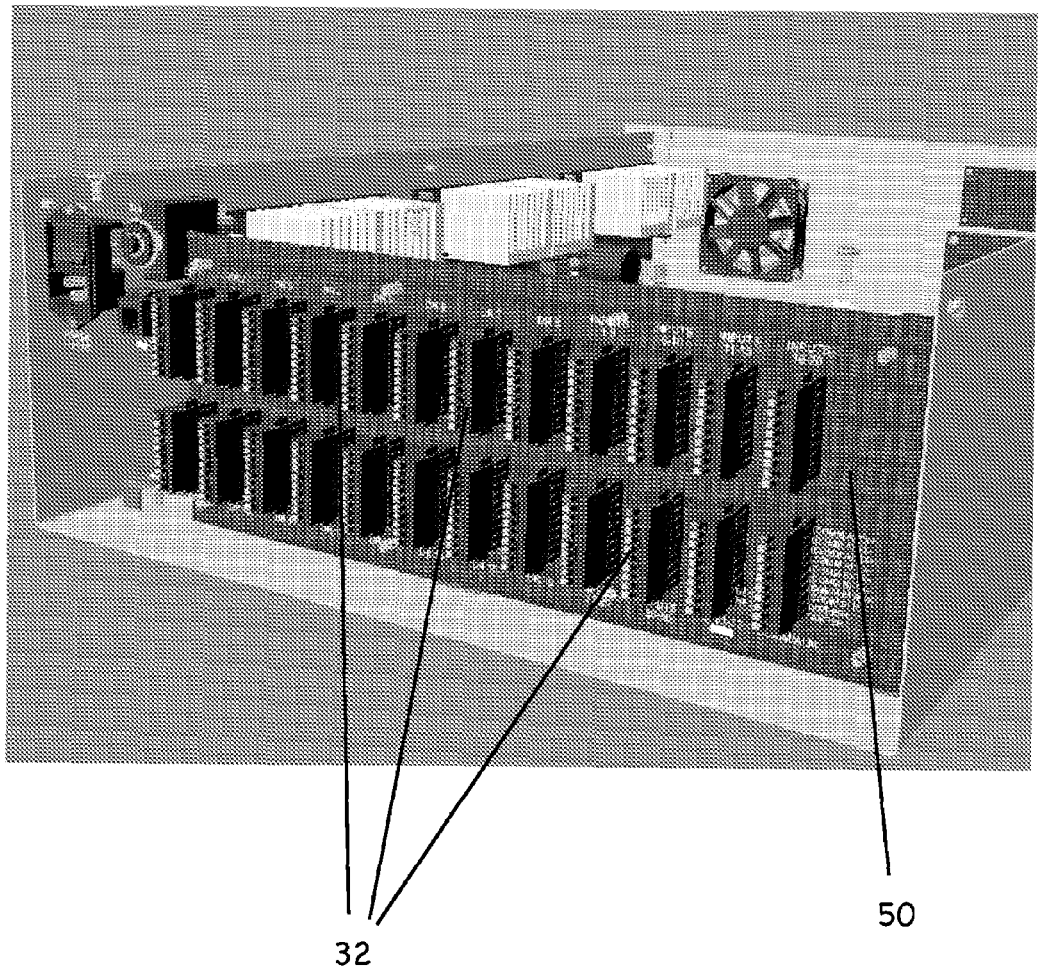
FIG. 4 depicts a circuit board that is integral to the rear panel shown in FIG. 4 on which the connectors are mounted.

FIG. 4 depicts a circuit board 50 integral to the rear panel 30 of panel 10 of FIG. 1. The illustrated circuit board 50 has connectors 32, electrically and mechanically coupled thereto and configured as shown.

Illustrated connectors 32 provide communications coupling, e.g., electrical connectivity, between the control boards 40 (via circuit board 40 and wiring harness 82 discussed below) and the aforementioned sensors or intrusion prevention devices (e.g., detectors, electrified locks, etc.). In the illustrated embodiment, each connector 32 has multiple conductors and screws, fast-locks, or other fastening devices that facilitate securing corresponding leads from cabling that lead to those sensors or intrusion prevention device—and, thereby, establishing electrical connectivity to the control boards (again, via the circuit board and wiring harness).

To this end, connectors 32 can be selected or configured for securing leads to conventional analog or digital sensors or intrusion prevention devices. An advantage of utilization of connectors 32 (rather than wire pass-through apertures of the type incorporated in most prior-art security panels) is that the field technician, or other person installing the panel 10 at a site, can simply attach leads from the sensors or security intrusion prevention devices to the connectors (rather than passing those leads through the panel) in order to establish coupling between the control boards 40 and those sensors or security intrusion prevention devices.

Figure 5:
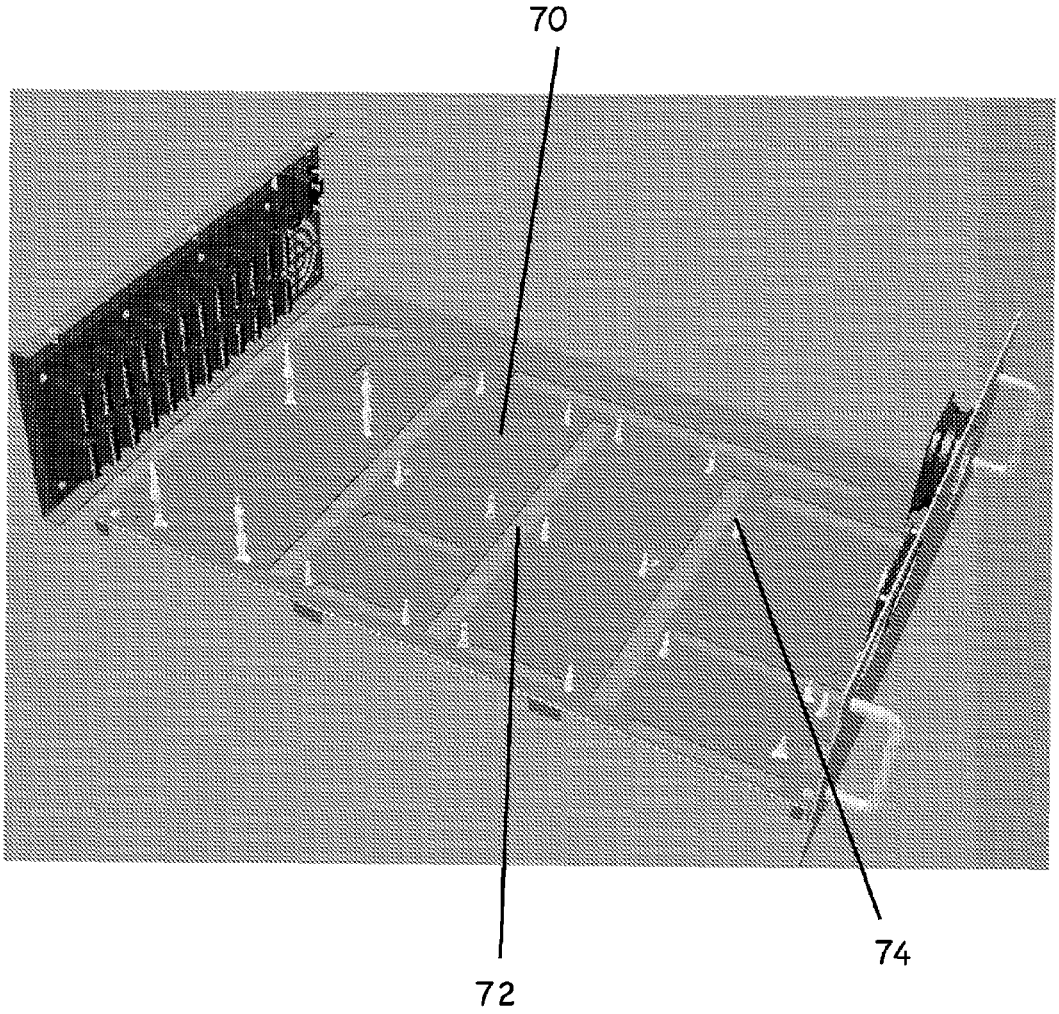
FIG. 5 is a detailed view of the backplane of FIG. 5.

FIG. 5 depicts a backplane 70 of the panel 10 of FIG. 1. Backplane 70 provides for electrical grounding and physical mounting of access control boards 40. In the illustrated embodiment, it includes mount points (e.g., screw holes, mount pins, etc.) for access control boards of multiple different manufacturers, though, other embodiments may support a limited variety of such boards. Illustrated backplane 70 comprises stamped metal piecework, though, in other embodiments it comprise printed circuit boards or other fabrications.

Figure 6:
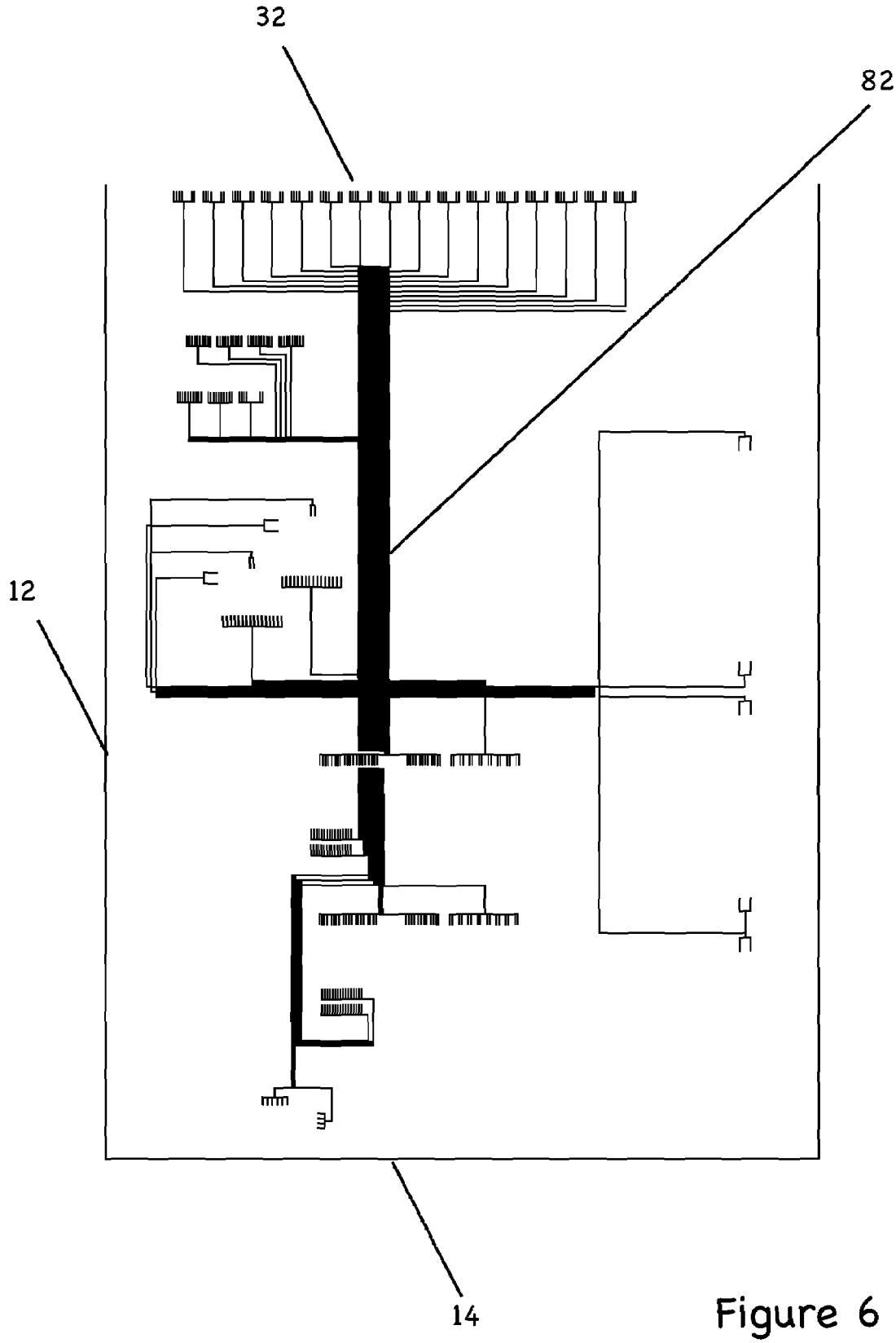
FIG. 6 depicts a physical diagram of the wiring harness.

FIG. 6 depicts a physical diagram of a wiring harness 82 for use in the security panel 10 of FIG. 1. The illustrated harness 82 provides electrical coupling and/or communications coupling between each of the connectors 32 and their respective control boards 40. In the illustrated embodiment, harness 82 comprises an arrangement of one or more bundled wires fabricated in the conventional manner known in the art as adapted in accord with the teachings hereof. Though a wire bundle is used in the illustrated embodiment, other embodiments may use flexible circuit boards and so forth.

Figure 7:
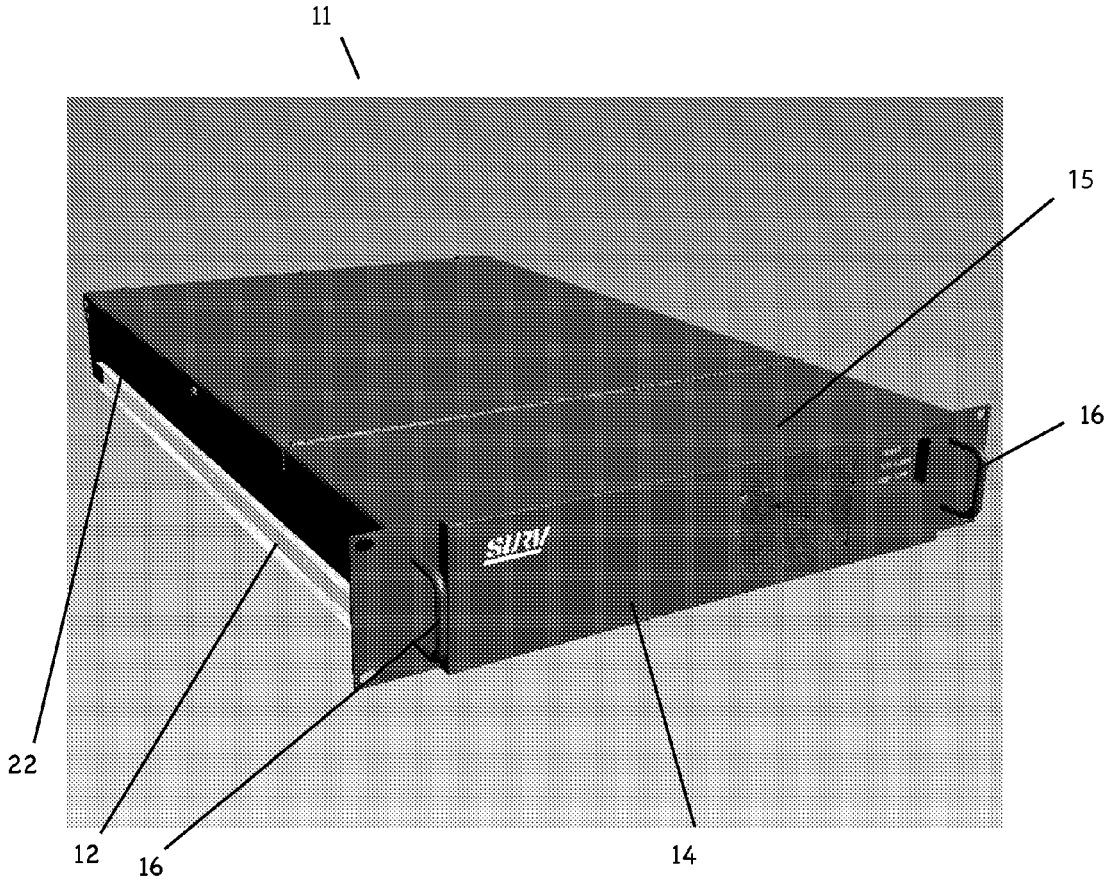
FIG. 7 depicts a 2 U rack-mounted access control panel according to one practice of the invention.

FIG. 7 depicts a rack-mounted access control panel 11 according to a further practice of the invention. It is generally configured and operated in the manner of the rack-mounted access control panel 10, discussed above. Additional aspects of the control panel 11 are detailed in the text that follows, in which element numbers are re-used from prior drawings to designate components similar to those discussed above.

The control panel 11 includes an enclosure 12, generally configured as described above, although in this embodiment (of FIG. 7) it has a height of 2 U—though, as above, it may be of a different height. The illustrated panel 11 additionally includes a hinged access port 15 located on a top, front portion of the enclosure 12, as shown. In other embodiments, the access port 15 may be located elsewhere and may be secured by mechanism(s) other than hinges. The hinged port 15 allows, among other things, easy access to the internals of the panel 11.

Unlike control panel 10, panel 11 does not include a fan (e.g., for the reasons discussed below), and nor does it include an LCD screen; although in other embodiments, such components may be present.

Figure 8:
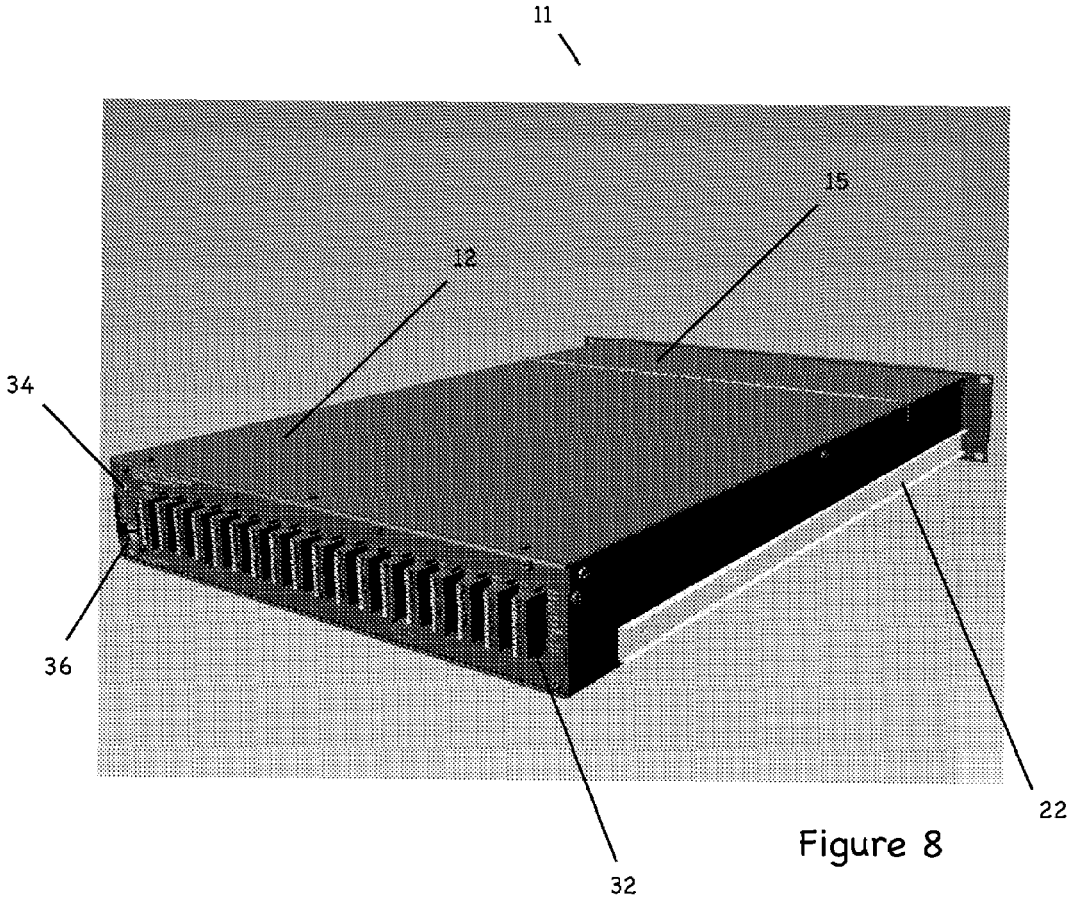
FIG. 8 depicts a rear of the enclosure of FIG. 7 and, specifically, depicts a rear panel having multiple connectors.

FIG. 8 depicts a rear view of the rack-mounted access control panel 11 of FIG. 7. In this embodiment, there is a single row of connectors 32 (unlike the dual row of the embodiment discussed above). Additionally, the panel 11 includes two LAN ports 36, although, in the illustrated embodiment, both LAN ports 36 are not simultaneously active. In other embodiments, they may be. The dual LAN ports provide, among other things, redundancy: the operator, field technician, or other person maintaining the panel 11 may switch a LAN cable from one port to the other in event of failure. Also, although not shown above, panel 10 may also include such a dual LAN port configuration.

The illustrated panel 11 also includes a removable shroud (not shown) at a rear portion of the enclosure 12. The shroud, among other things, protects the cables and connectors 32 from dust, debris, or other hazards (e.g., incurred while mounted in the rack). In this embodiment, the shroud is affixed to the rear of the panel 11 with screws, and has an open bottom that allows for cabling to be attached to the connectors 32, although in other embodiments, it may be configured otherwise.

Figure 9:
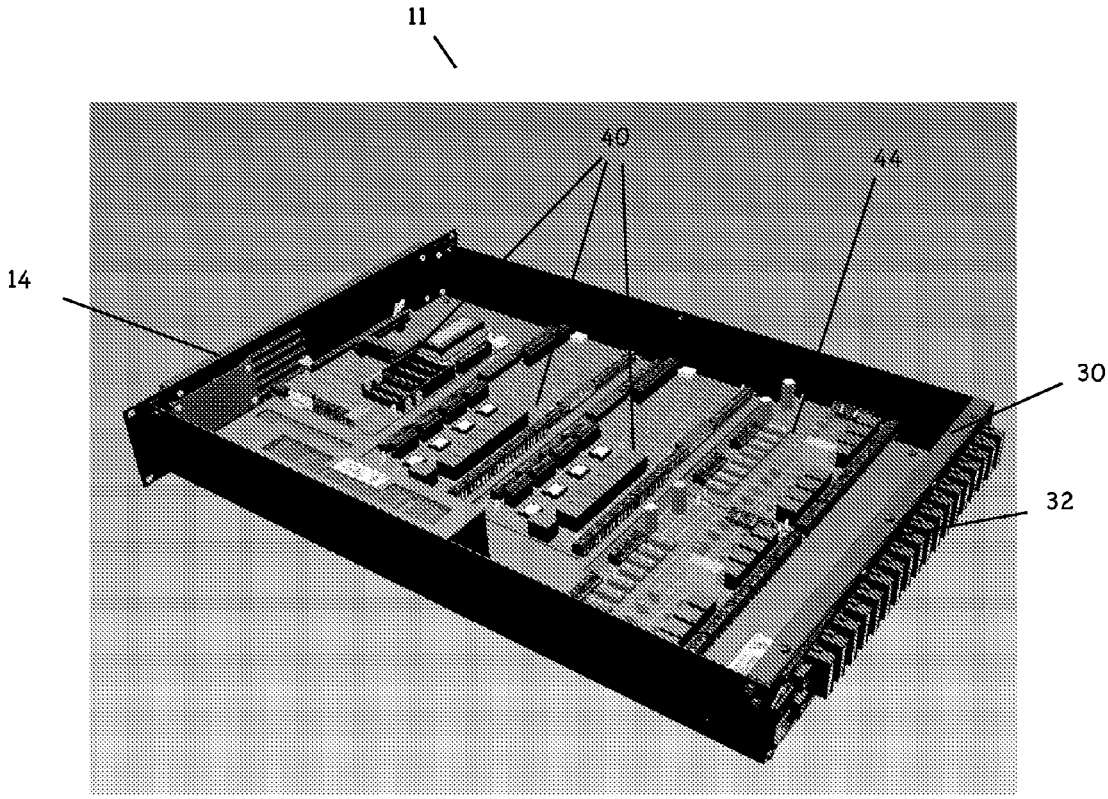
FIG. 9 depicts the internals of the access control panel of FIG. 7.

FIG. 9 depicts the internals of the access control panel 11 of FIG. 7. The transformer in this embodiment provides step-down power to a single power supply which provides power only for the panel 11 itself and not for any peripheral devices (e.g., magnetic locks, sensors, etc.). This has the advantage, among other things, of generating lower temperatures within the panel 11, thereby removing the need for a fan. As with the embodiment discussed above, the transformer may be powered by an external UPS (not shown).

Figure 10:
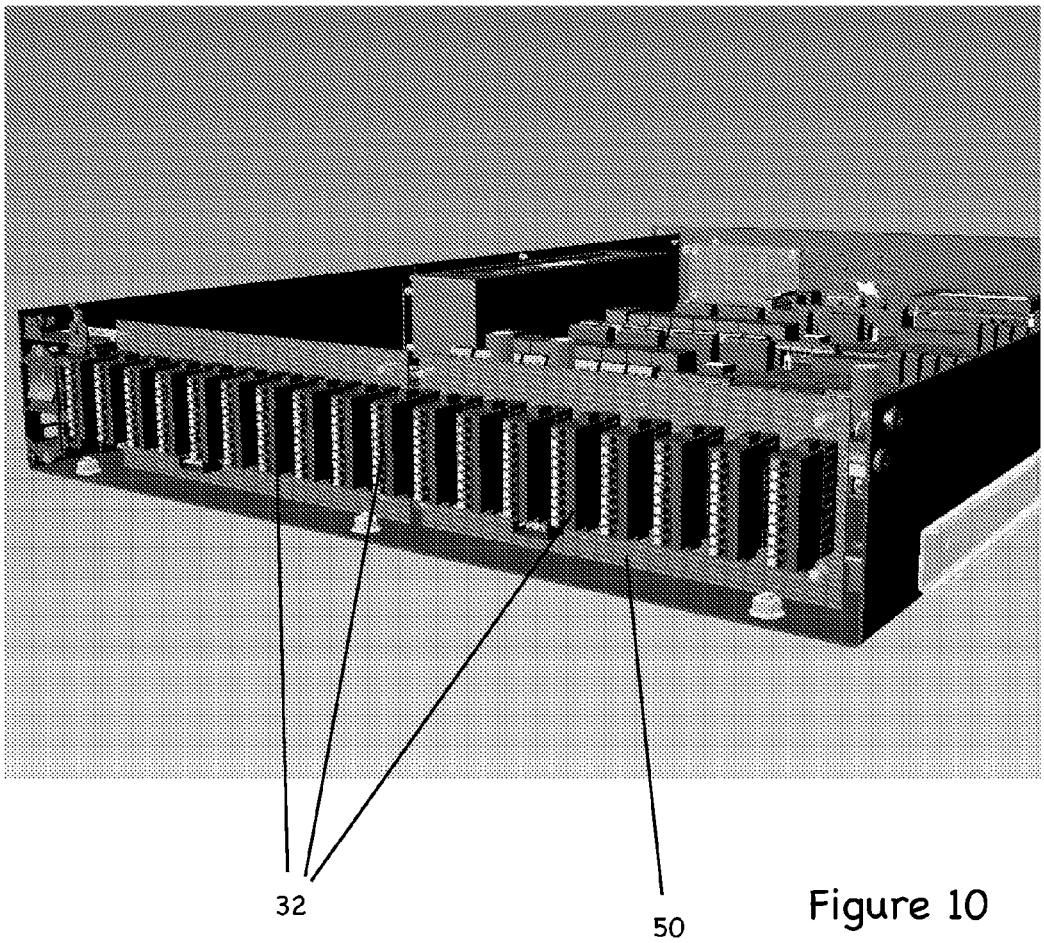
FIG. 10 depicts depicts a circuit board that is integral to the rear panel shown in FIG. 9 on which the connectors are mounted.

FIG. 10 depicts a circuit board 50 integral to the rear panel 30 of control panel 11 of FIG. 7. That board 50 is generally configured and operated as described above in connection with FIG. 4.

Figure 11:
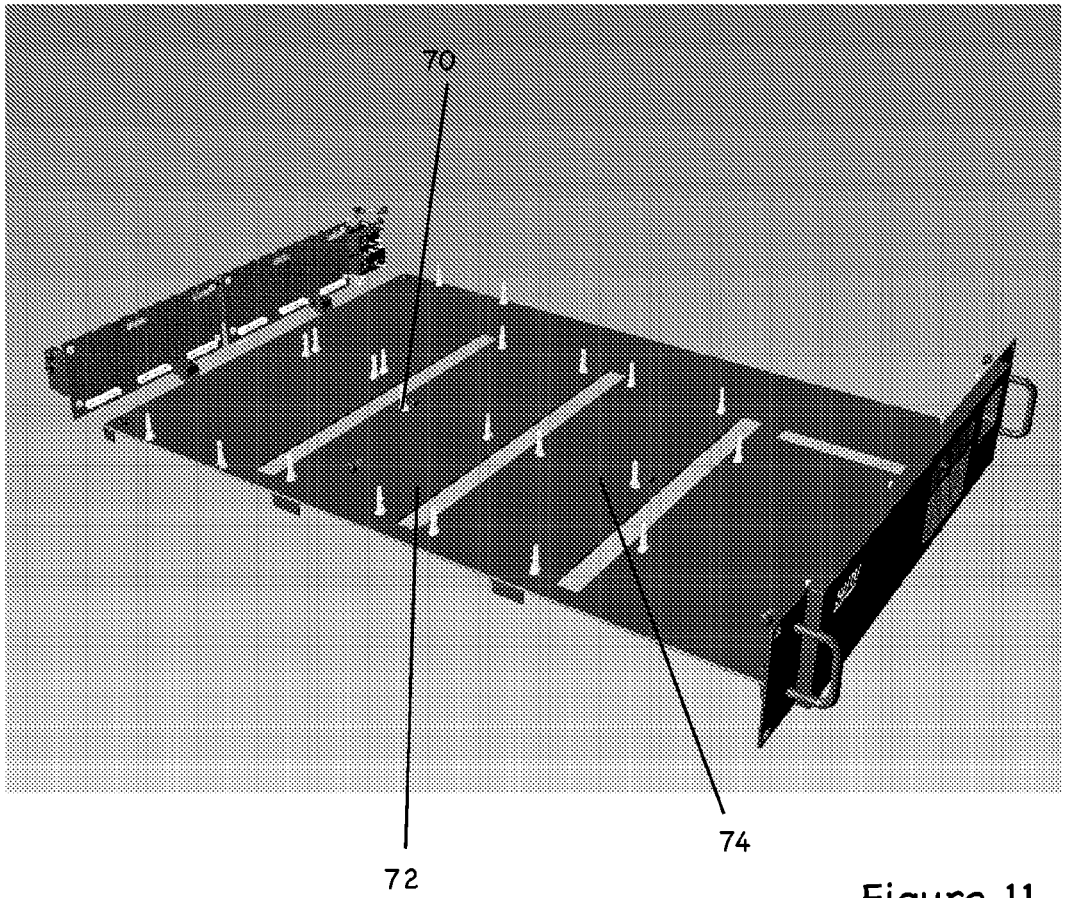
FIG. 11 depicts a detailed view of the backplane of FIG. 10.

FIG. 11 depicts a backplane 70 of the control panel 11 of FIG. 7. That backplane 70 is generally configured as described above in connection with FIG. 5.

Described above are devices and methods meeting the aforementioned objects, among others. Those skilled in the art will appreciate that the embodiments discussed and shown herein are merely examples of the invention and that other embodiments fall within the scope thereof.

The invention claimed is:

1. An access control panel that monitors and/or controls access to a building or other property comprising:

A. a rack-mount enclosure having disposed therein one or more access control boards that
   i. receive signaling from one or more security devices, each comprising any of a sensor and/or an intrusion prevention device, and/or
   ii. control access to one or more entry points and/or zones to said building or other property, B. at least one connector providing communications coupling between at least one of the access control boards and at least one of the security devices, and C. wherein at least one of
   i. a plurality of connectors are mounted or disposed in a single row on a rear panel of the enclosure,
   ii. the enclosure is two rack-units (2 U) high,
   iii. the enclosure includes a hinged access port providing access to at least a component disposed within that enclosure.

2. The access control panel of claim 1, wherein a plurality of connectors are mounted or disposed in a single row on a rear panel of the enclosure.

3. The access control panel of claim 2 comprising dual LAN ports.

4. The access control panel of claim 2, comprising a printed circuit board comprises or is integral to the rear panel.

5. The access control panel of claim 1, wherein the enclosure is two rack-units (2 U) high.

6. The access control panel of claim 1, wherein the enclosure includes a hinged access port providing access to at least a component disposed within that enclosure.

7. The access control panel of claim 1, wherein the enclosure includes a removable shroud mounted on a rear portion of the enclosure, the shroud protecting at least the connectors, and/or communication couplings, from materials that can damage such components.

8. The access control panel of claim 1, wherein said at least one connector provides communication coupling between at least one of the access control boards and at least one of the security devices without requiring requiring that a field technician, or other person installing the panel at a site, pass wire through the enclosure in order to establish that communications coupling.

9. The access control panel of claim 8, wherein the access control boards comprise multiple different platforms.

10. The access control panel of claim 1, comprising a wiring harness that carries communication signals from the one or more connectors to one or more control boards.

11. The access control panel of claim 1, where the access control panel comprises one or more power and/or electrical interfaces that support the control boards and the sensors and/or intrusion prevention devices.

12. The access control panel of claim 1, comprising a power unit providing power to the control panel.

13. The access control panel of claim 1, wherein the enclosure comprises a backplane in which one or more access control boards are mounted or disposed.

14. The access control panel of claim 13, wherein the backplane comprises one or more arrangements of apertures and/or mounting pins to support mounting of the access control boards.

* * * * *